US009309722B2

(12) United States Patent
Kibsgaard et al.

(10) Patent No.: US 9,309,722 B2
(45) Date of Patent: Apr. 12, 2016

(54) OIL OPERATED ROTARY STEERABLE SYSTEM

(75) Inventors: Paal Kibsgaard, Houston, TX (US); Geoffrey C. Downton, Gloucestershire (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 589 days.

(21) Appl. No.: 13/699,617

(22) PCT Filed: Jun. 17, 2011

(86) PCT No.: PCT/US2011/040893

§ 371 (c)(1), (2), (4) Date: Jan. 22, 2013

(87) PCT Pub. No.: WO2011/160027

PCT Pub. Date: Dec. 22, 2011

(65) Prior Publication Data

US 2013/0112483 A1 May 9, 2013

Related U.S. Application Data

(60) Provisional application No. 61/356,442, filed on Jun. 18, 2010.

(51) Int. Cl.
*E21B 7/06* (2006.01)
*E21B 7/10* (2006.01)

(52) U.S. Cl.
CPC . *E21B 7/06* (2013.01); *E21B 7/067* (2013.01); *E21B 7/10* (2013.01)

(58) Field of Classification Search
CPC ..... E21B 17/1014; E21B 7/06; E21B 7/067; E21B 7/10
See application file for complete search history.

(56) References Cited

U.S. PATENT DOCUMENTS

| | | | | |
|---|---|---|---|---|
| 4,548,282 | A * | 10/1985 | Hurtz et al. | 175/61 |
| 6,109,372 | A * | 8/2000 | Dorel et al. | 175/61 |
| 2003/0127252 | A1 | 7/2003 | Downton et al. | |
| 2006/0243487 | A1* | 11/2006 | Turner et al. | 175/26 |
| 2006/0249287 | A1* | 11/2006 | Downton et al. | 166/250.1 |
| 2007/0235227 | A1* | 10/2007 | Kirkhope et al. | 175/73 |
| 2009/0032302 | A1 | 2/2009 | Downton et al. | |
| 2009/0223717 | A1* | 9/2009 | Eppink | 175/25 |

FOREIGN PATENT DOCUMENTS

WO 2009/002996 12/2008

* cited by examiner

*Primary Examiner* — Shane Bomar
*Assistant Examiner* — Christopher Sebesta

(57) ABSTRACT

A technique facilitates steering of rotary steerable systems when conducting directional drilling operations. A rotary steerable system is combined with a pressurized oil system which delivers oil to a piston actuated mechanism. The pressurized oil provides precise, long-lasting control over the orientation of the bottom hole assembly and the drill bit to facilitate directional drilling of boreholes through subterranean formations.

11 Claims, 2 Drawing Sheets

OIL OPERATED ROTARY STEERABLE SYSTEM

CROSS-REFERENCE TO RELATED APPLICATION

The present document is based on and claims priority to U.S. Provisional Application Ser. No. 61/356,442, filed Jun. 18, 2010, incorporated herein by reference.

BACKGROUND

Rotary steerable drilling systems for drilling deviated boreholes into the earth are generally classified either as point-the-bit systems or push-the-bit systems. In point-the-bit systems, the axis of rotation of the drill bit is deviated from the local axis of the bottom hole assembly in the general direction of the new portion of the hole being drilled. The borehole is propagated according to customary three-point geometry defined by upper and lower stabilizer touch points and the drill bit. The angle of deviation of the drill bit axis coupled with a finite distance between the drill bit and a lower stabilizer results in a non-collinear condition required for a curve to be generated. In this type of system, the drill bit tends to have less sideways cutting because the bit axis is continually rotated in the direction of the curved borehole.

In push-the-bit rotary steerable systems, there is usually no specially identified mechanism to deviate the bit axis from the local bottom hole assembly axis. Instead, the requisite non-collinear condition is achieved when either upper or lower stabilizers are used to apply an eccentric force or displacement in a direction oriented with respect to the direction of borehole propagation. Steering is again achieved by creating non co-linearity between the drill bit and at least two other touch points. In this type of system, the drill bit is required to cut sideways to generate the desired, curved borehole.

In many of these rotary steerable systems, pistons may be used to create force against a borehole wall or to cause angular displacement of one steerable system component with respect to another to cause the drill bit to move in the desired direction of deviation. The pistons are deployed in a piston actuated mechanism and forced to their desired displacement to achieve the directional control. The pistons are manipulated via drilling mud pumped down through the bottom hole assembly. However, such systems may be subjected to internal wear from the flowing mud and also may be limited with respect to the forces which may be applied to steer the drill bit.

SUMMARY

In general, the present invention provides a technique which facilitates steering of steerable systems when conducting directional drilling operations. A directional drilling system (e.g. a rotary steerable system) is preferably combined with a pressurized oil system which delivers oil to a piston actuated mechanism. The pressurized oil provides precise, long-lasting control over the orientation of the bottom hole assembly and the drill bit to facilitate directional drilling of boreholes through subterranean formations.

BRIEF DESCRIPTION OF THE DRAWINGS

Certain embodiments of the invention will hereafter be described with reference to the accompanying drawings, wherein like reference numerals denote like elements, and.

DETAILED DESCRIPTION

In the following description, numerous details are set forth to provide an understanding of the present invention. However, it will be understood by those of ordinary skill in the art that the present invention may be practiced without these details and that numerous variations or modifications from the described embodiments may be possible.

The disclosure herein generally relates to a steering system for directional drilling. A bottom hole assembly incorporates a rotary steerable system having a piston actuated mechanism. However, the piston actuated mechanism is controlled by pressurized oil supplied from a pressurized oil system rather than being controlled by flowing drilling mud. The flow of oil to pistons of the piston actuated mechanism is controlled by a valve system. The valve system allows the pressurized oil to be ported to the pistons of the rotary steerable system to, for example, point the bit in the desired steering direction. The force required to manage the reactive forces from weight on bit (WOB), bottom hole assembly (BHA) mass and other drilling loads is provided by the pressure differential between the annulus and the pressurized oil acting across the piston area of the pistons. The separate pressurized oil system may be used with, for example, point-the-bit type systems, push-the-bit systems, or other types of steerable drilling systems.

Figure 1:
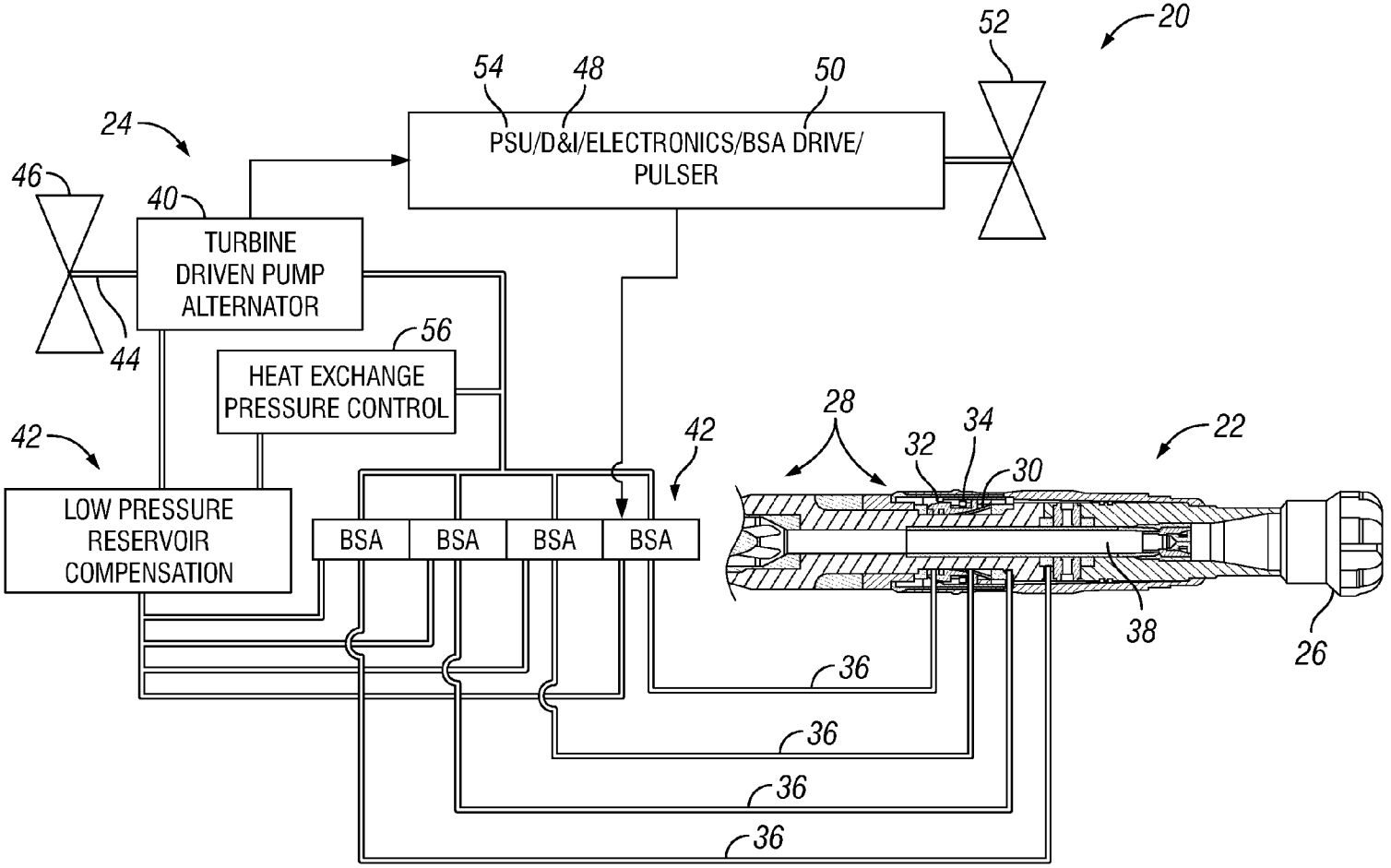
FIG. 1 is a schematic illustration of a rotary steerable system coupled with a pressurized oil system, according to an embodiment of the present invention.

Referring generally to FIG. 1, an embodiment of a drilling system 20 is illustrated. In this embodiment, drilling system 20 comprises a bottom hole assembly 22 coupled with a pressurized oil system 24. The bottom hole assembly 22 comprises a drill bit 26 connected to a rotary steerable system 28 having a steering section 30 which is selectively manipulated via a piston actuated mechanism 32 having a plurality of pistons 34. Pressurized oil system 24 is employed to route pressurized oil to piston actuated mechanism 32 and to selected pistons 34 via oil supply lines 36. The pressurized oil is used to move specific pistons 34 which changes the orientation of the drill bit 26, e.g. changes the drilling axis orientation, with respect to the longitudinal axis 38 of the bottom hole assembly 22. For example, the pistons 34 may be employed to control at least one of the directional bias and the axial orientation of the drill bit 26. The pistons 34 may be arranged, for example, to point the drill bit 26 or to push the drill bit 26. By way of specific example, the drilling system 20 utilizes rotary steerable system 28 which rotates with the plurality of pistons/actuators 34. Additionally, the rotary steerable system 28 may be used in conjunction with stabilizers, such as non-rotating stabilizers.

Pressurized oil system 24 may comprise an oil pump 40 which pressurizes the oil supplied through oil supply lines 36 for controlling the drilling orientation of the rotary steerable system 28. The pressurized oil from pump 40 may be routed through a valve system 42 used to control the flow and pressure of the oil supplied to pistons 34 of rotary steerable system 28 and piston actuated mechanism 32.

In the embodiment illustrated, oil pump 40 is driven by a shaft 44 which, in turn, may be driven directly by flowing drilling mud flowing through a turbine 46 or other device designed to power oil pump 40. Alternatively, the oil pump 40 may be powered by an electric motor 48. In the case of an electric motor, electrical power may be provided to motor 48 by an alternator 50. By way of example, the alternator 50 may be driven by drilling mud, e.g. driven by drilling mud via a mud turbine or mud pump (PDM) 52. In the embodiment employing electric motor 44, a speed control system 54 may be implemented to maintain a constant pump pressure. In the embodiment in which pump 40 is a direct mud driven pump, the pressure may be maintained by an internal pressure relief valve 56. It should be noted that electrical power may be supplied to motor 48 from other sources, e.g. from a surface supply coupled to electric motor 48 via cable or other conductors routed downhole.

The motive fluid for steering rotary steerable system 28, e.g. oil supplied through oil supply lines 36, works between a high-pressure source and a low-pressure reservoir. The low-pressure reservoir may be pressure balanced with the pressure internal to the drill string. The power required to provide the cyclic steering forces as the drill string rotates often requires a mechanical source of energy of several kWatts. For example, 5000 pounds acting over 0.25 square inches requires 141 joules at four times a second (240 rpm)–mechanical power of 1700 Watts assuming there is no energy recycling/storage.

The valve system 42 employs valves to control the flow of pressurized oil into/out of the pistons 34, and those valves may comprise bistable actuators (low energy fluid flow switches) or piezo restrictive actuator valves. As an alternative, the valve system 42 may employ a rotary valve format, such as the rotary valve format used in the PowerDrive rotary steerable system available from Schlumberger Corporation. In either case, the system is designed to track the local gravity vector to enable the system to determine which valves are to be activated to achieve the required steering response taking into account the various tool face offset effects that exist due to friction, bit response, bottom hole assembly load, formation tendencies, and other potential factors. The gravity and valve data may be provided by suitable sensors. However, other types of valves and sensor systems may be employed in pressurized oil system 24 to control the flow of pressurized oil.

By using the separate pressurized oil system 24 to control the orientation of rotary steerable system 28, less internal wear results which enables extended runtimes and a reduction in tools for each drilling job. The pressurized oil system also is amenable to higher pressure which, in turn, enables actuation by smaller pistons 34, thereby providing more flexibility with respect to both packaging and actuation. The pressurized oil system 24 further enables use of higher forces while eliminating the coupling of actuation force and flow rate of the drilling mud. Additionally, the system 20 no longer requires relatively high bit drop pressures. The pressurized oil also can be combined with oil needed for other drilling systems. Depending on the specific application, the pressurized oil system 24 may be located in whole or in part downhole along the drill string. For example, the oil pump 40 and the valve system 42 may be located anywhere in the bottom hole assembly. The rotary steerable system 28 and the pressurized oil system are designed so that the pistons 34 can be actuated independently to achieve a straight ahead steering. Additionally, the design of the system enables modulation of the piston displacement and forces in synchronism with the phase of drill string rotation to achieve intermediate steering curvatures.

Figure 2:
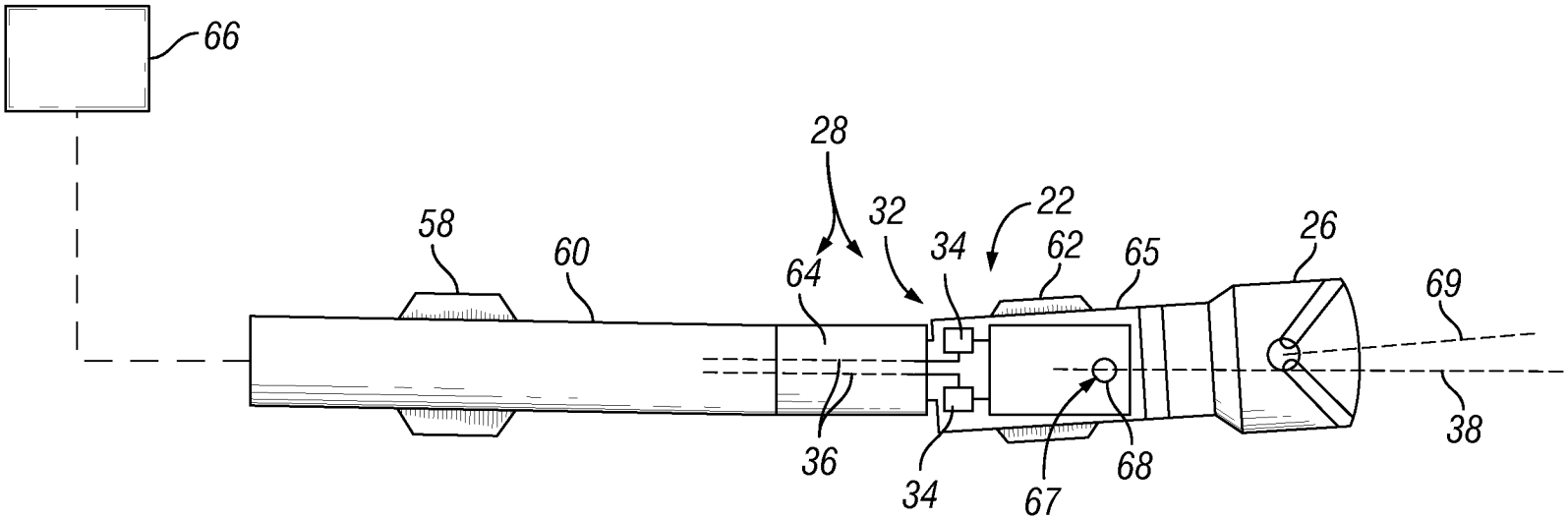
FIG. 2 is a schematic example of one type of bottom hole assembly and rotary steerable system incorporating pistons which are controlled by the pressurized oil system, according to an embodiment of the present invention.

The pressurized oil system 24 may be used in combination with a variety of bottom hole assemblies 22 and rotary steerable systems 28. However, one example of a suitable bottom hole assembly is illustrated in FIG. 2. A similar bottom hole assembly is described in U.S. Pat. No. 7,188,685. In this example, bottom hole assembly 22 combines both point-the-bit and push-the-bit technologies. It should be noted, however, the pressurized oil system 24 may be combined with a variety of other types of steerable bottom hole assemblies for use in directional drilling. For example, the rotary steerable system 28 may be a purely point-the-bit system or a purely push-the-bit system.

In the example illustrated, bottom hole assembly 22 comprises an upper stabilizer 58 mounted on a collar 60 which may be positioned adjacent rotary steerable system 28. A lower stabilizer 62 is attached to an upper section 64 of rotary steerable system 28. A steering section 65 is connected to drill bit 26. A surface control system 66 may be utilized to communicate steering commands to electronics in upper section 64. In some embodiments, the rotary steerable system 28 rotates with the pistons/actuators 34 and the stabilizers 58 and/or 62 may comprise non-rotating stabilizers.

The drill bit 26 is tilted about a swivel 67 which may be in the form of a universal joint 68. In this embodiment, the steering section 65 is selectively actuated (e.g. pivoted/rotated) about swivel 67 with respect to upper section 64 to actively maintain a bit axis 69 pointing in a particular direction while the bottom hole assembly is rotated at a desired rotational speed of the drill string. Pistons 34 act on a periphery of the steering section 65 to apply a force for tilting the drill bit 26 with respect to the bottom hole assembly or tool axis 38. The direction or orientation of the drill bit 26 broadly defines the direction of borehole formation. In a push-the-bit type system, the pistons 34 can be configured to act against the surrounding wellbore wall.

In one example, pistons 34 are sequentially actuated by virtue of the pressurized oil from oil system 24 as steering section 65 pivots/rotates. This enables the desired tilt of the drill bit 26 to be actively maintained to ensure drilling in a desired direction through the formation. In other embodiments and situations, the pistons 34 may be intermittently actuated in a random manner by the pressurized oil supplied through oil supply lines 36 to, for example, drill straight ahead as discussed above. In still other embodiments and situations, the pressurized oil from oil system 24 is used to actuate pistons 34 in a directionally-weighted semi-random manner to provide for less aggressive steering as the steering section 65 pivots/rotates. In some situations, the pressurized oil system 24 may be used to activate either all or none of the pistons 34 simultaneously to lock the steering sleeve, e.g. steering section 65, in a drill ahead configuration and/or to reduce wear on the steering actuators. A variety of methods may be employed to measure the sleeve angle so as to improve control over the toolface and to improve control over the direction in which the sleeve is oriented. As described above, the steering may be achieved by synchronously modulating the pistons 34 in both force and displacement in phase relationship with the desired toolface pointing direction. Accordingly, the pressurized oil system 24 provides great flexibility for controlling directional drilling in a variety of applications and with many types of bottom hole assemblies 22 and rotary steerable systems 28.

Although only a few embodiments of the present invention have been described in detail above, those of ordinary skill in the art will readily appreciate that many modifications are possible without materially departing from the teachings of this invention. Accordingly, such modifications are intended to be included within the scope of this invention as defined in the claims.

What is claimed is:

1. A system for drilling a borehole, comprising:

a drill bit;

a rotary steerable drilling system to which the drill bit is coupled in a bottom hole assembly, the rotary steerable drilling system being configured to receive a flowing drilling mud and comprising a mechanism for rotating the drill bit to drill the borehole, the rotary steerable drilling system also having a piston actuated mechanism which rotates with the rotary steerable drilling system and which selectively controls at least one of the directional bias or the axial orientation of the drill bit;

a turbine powered independently of the mechanism for rotating the drill bit, the turbine being powered by the flowing drilling mud; and a pressurized oil system connected to the piston actuated mechanism, the pressurized oil system providing pressurized oil to pistons in the piston actuated mechanism, wherein the pressurized oil system comprises an oil pump driven by a shaft which, in turn, is driven by the turbine powered via the flowing drilling mud, the pressurized oil system further comprising an internal pressure relief valve positioned to maintain a constant pump pressure.

2. The system is recited in claim 1, wherein the rotary steerable drilling system comprises a swivel.

3. The system is recited in claim 1, wherein the rotary steerable drilling system comprises a lower stabilizer.

4. The system is recited in claim 1, wherein the flow of oil from the oil pump to the piston actuated mechanism is controlled by a valve system.

5. The system as recited in claim 4, wherein the valve system comprises a plurality of bistable actuators.

6. A method of drilling a borehole, comprising:

rotating a drill bit with a mechanism of a rotary steerable system which rotates a plurality of actuator pistons about the borehole;

delivering a flowing drilling mud through the rotary steerable system;

using at least a portion of the flowing drilling mud to power a turbine independently of said mechanism;

adjusting the orientation of the rotary steerable system and thus the drill bit with pressurized oil supplied to the rotary steerable system via an oil pump driven by the turbine;

drilling a directional borehole in a desired orientation as a result of adjusting the orientation of the rotary steerable system with pressurized oil delivered to the rotary steerable system separately from the flowing drilling mud used during drilling, the pressurized oil being delivered to sequentially actuate selected actuator pistons of the plurality of actuator pistons during rotation of the plurality of actuator pistons; and maintaining a constant pressure on the pressurized oil.

7. The method as recited in claim 6, further comprising controlling flow of oil to the plurality of actuator pistons by a valve system.

8. The method as recited in claim 6, further comprising providing the rotary steerable system with a stabilizer.

9. A method of drilling a wellbore, comprising:

conveying a rotary steerable system downhole with a mud motor;

delivering drilling fluid down through the mud motor and the rotary steerable system to remove cuttings;

using a component of the rotary steerable system for rotating a drill bit;

steering the rotary steerable system with a pressurized oil system separated from the drilling fluid, wherein steering comprises pressurizing the pressurized oil with an oil pump located downhole;

controlling the steering by selectively delivering the pressurized oil to actuator pistons which are rotated about the wellbore by the rotary steerable system;

driving the oil pump with an electric motor located downhole, the electric motor being operated independently of the component of the rotary steerable system used for rotating the drill bit; and maintaining a constant oil pump pressure with a speed control system controlling the electric motor.

10. The method as recited in claim 9, further comprising modulating actuator piston displacement and forces in synchronism with the phase of drill string rotation to achieve intermediate steering curvatures.

11. The method as recited in claim 9, wherein steering is achieved by synchronously modulating the actuator pistons in force and displacement in phase relationship with the desired toolface orientation.

* * * * *